United States Patent [19]

Lombardi

[11] 3,972,047

[45] July 27, 1976

[54] FLOATING CABLE ANTENNA SYSTEM

[75] Inventor: Anthony Joseph Lombardi, Flanders, N.J.

[73] Assignee: International Telephone and Telegraph Corporation, Nutley, N.J.

[22] Filed: Aug. 25, 1975

[21] Appl. No.: 607,168

[52] U.S. Cl. ..... 343/709; 343/719; 343/742; 343/877

[51] Int. Cl.[2] ..... H01Q 1/34

[58] Field of Search ..... 343/709, 710, 719, 742, 343/877

[56] References Cited

UNITED STATES PATENTS 1,557,049 10/1925 Hammond ..... 343/709

*Primary Examiner*—Eli Lieberman

*Attorney, Agent, or Firm*—John T. O'Halloran; Peter Van Der Sluys; Alfred C. Hill

[57] ABSTRACT

A buoy is towed by a submerged submarine through means of an electro-mechanical cable. A cable reel is disposed in the buoy to store an inflatable buoyant cable having a pressure accumulator containing a medium under a given pressure attached to one end of the buoyant cable adjacent the outer surface of the buoy. The other end of the buoyant cable is attached to the cable reel. Through slip rings connected to the cable reel and a conductor connected between the slip rings and the electro-mechanical cable radio communication with a submerged submarine is possible employing the buoyant cable when it is deployed and inflated. An arrangement in the buoy associated with the buoyant cable and the cable reel assists in deploying and retrieving the buoyant cable with the deploying and retrieving of the buoyant cable being under the control of sea pressure acting on the buoyant cable.

22 Claims, 9 Drawing Figures

10
9
4
11
6
6
7
8
5
5
5
15
16
6
14
13

17
18
5
19
17
7
8
23
22
24
5
19
18
17
5
17

FLOATING CABLE ANTENNA SYSTEM

BACKGROUND OF THE INVENTION

This invention relates to antenna systems and more particularly to a Floating cable antenna system for a submerged submarine.

In recent years it has been demonstrated that an effective means of communicating between the outside world and a submerged submarine is through a floating cable antenna system. This antenna system operates by deploying a floating cable approximately 0.625 inches in diameter from a submerged submarine. The cable floats to the surface where it receives radio communications and conveys them down to the receiving equipment located in the submarine. Under these conditions the submarine can remain submerged and undetected, which is a very desirable feature, especially in times of national emergency.

Floating cable antennas presently in use are made buoyant by a semi-rigid plastic foam jacket that covers the electrical conductor serving as the antenna. Cables of this type have exhibited marginal buoyancy, required large storage reels and complicated deployment and retrieval mechanisms.

SUMMARY OF THE INVENTION

An object of the present invention is to provide a floating cable antenna system where the floating cable antenna is made buoyant by inflating, is stored in the deflated condition, and is automatically deployed and retrieved by the action of sea pressure.

Another object of the present invention is to provide a floating cable antenna system which is automatically deployed and retrieved under control of sea pressure from a buoy towed by a submerged submarine.

A feature of the present invention is the provision of a floating cable antenna system for a submerged submarine comprising: a buoy; an electro-mechanical cable connecting the buoy to the submarine; an inflatable buoyant cable having a pressure accumulator containing a medium under a given pressure attached to one end of the buoyant cable adjacent the outer surface of the buoy; a cable reel disposed in the buoy to store the buoyant cable, the other end of the buoyant cable being attached to the cable reel; and an arrangement in the buoy associated with the buoyant cable and the cable reel to assist in deploying and retrieving the buoyant cable, the deploying and retrieving the buoyant cable being under the control of sea pressure acting on the buoyant cable.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
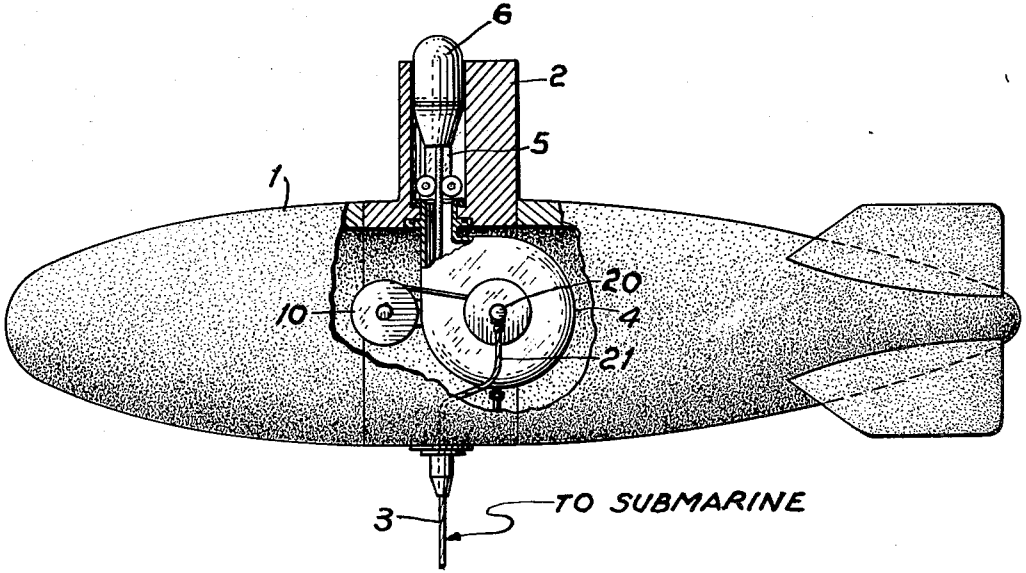
FIG. 1 is a schematic illustration, partially in cross-section, of a hydrodynamic shaped buoy towed by a submarine containing therein the floating cable antenna system shown in its stowed condition in accordance with the principles of the present invention.

Referring to FIG. 1, the floating cable antenna system for a submerged submarine in accordance with the principles of the present invention includes a buoy 1 having a hydrodynamic shape with a faired mast 2 formed as an integral part of buoy 1. Buoy 1 is towed by the submerged submarine by an electro-mechanical tow cable 3 with the electrical portion of cable 3 providing radio communication between buoy 1 and the submerged submarine. Buoy 1 includes a buoyant cable reel 4 to store the buoyant cable 5 in a stowed condition. To the end of buoyant cable 5 disposed in faired mast 2 is a pressure accumulator 6 containing therein a medium, such as air, under a given pressure. The faired mast 2 houses and protects accumulator 6 when accumulator 6 and buoyant cable 5 are in a stowed condition.

Figure 2:
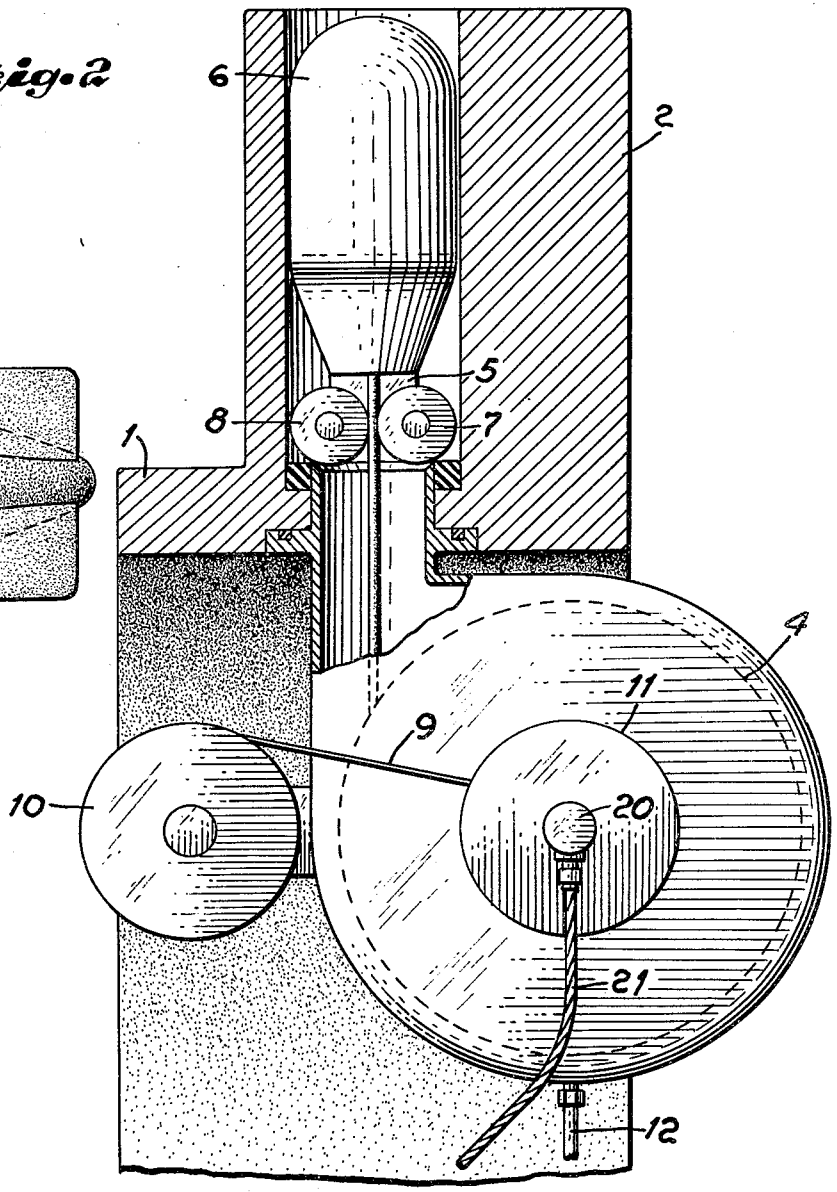
FIG. 2 is a more detailed schematic illustration of the floating cable antenna system of FIG. 1.
Figure 3:
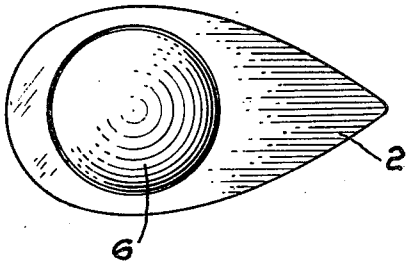
FIG. 3 is a top view of the faired mast incorporated as an integral part of the buoy of FIG. 1.

Referring to FIGS. 2 and 3 there is illustrated in greater detail the essential components required to effect the operation of deploying and retrieving buoyant cable 5. Accumulator 6 in its stowed condition is disposed in faired mast 2. The accumulator 6 is attached to one end of cable 5 and is made of crushproof material. The other end of buoyant cable 5 passes through resilient pinch rollers 7 and 8 and is stored on cable reel 4 in one cable width and in successive layers. Cable 5 below pinch rollers 7 and 8 is in its deflated condition, while that portion thereof above pinch rollers 7 and 8 is in an inflated condition. Take-up spring 9 is wound up on take-up reels 10 and 11 depending on whether buoyant cable 5 is being deployed or retrieved. Take-up reel 11 is keyed to cable reel 4 so that torsional forces exerted by take-up spring 9 will be transmitted to cable reel 4.

The following sequence of operation is presented to clearly outline the operations involved in deploying and retrieving the floating cable antenna when it is housed within buoy 1, with buoy 1 either being housed on or towed by a submarine, and is cycled through the normal phases encountered during submarine operation, that is, surfaced, submerged, surfaced.

Under the first condition the assumption is made that the submarine is operating on the surface or at a shallow depth and that buoy 1 is housed on the submarine (not towed). At this depth the air pressure in accumulator 6 is greater than the sea pressure on buoyant cable 5. This condition causes buoyant cable 5 to inflate and exert sufficient force against pinch rollers 7 and 8 to overcome the torsional force of take-up spring 9. However, because deployment under the above stated conditions is undesirable, a solenoid operated locking means (not shown) acting against accumulator 6 maintains the antenna system in a stowed condition.

The second condition assumes that the submarine is submerging to its operational depth and buoy 1 is still housed on the submarine. Since the locking means against accumulator 6 is still engaged, buoyant cable 5 and accumulator 6 remain in the stowed condition.

The third condition assumes that the submarine has reached its operational depth, that the tethered buoy 1 is released from the submarine cradle, and buoy 1 is ascending to its operational depth of approximately 50 feet below the surface. To enable buoy 1 to ascend to its operational depth, the solenoid operated locking means is actuated, thereby releasing accumulator 6 and permitting accumulator 6 and buoyant cable 5 to deploy. The deployment sequence is as follows. When buoy 1 is approaching its operational depth the sea pressure on buoyant cable 5 is gradually diminishing thereby allowing the stored air pressure from accumulator 6 to inflate the section of buoyant cable 5 that extends from accumulator 6 to pinch rollers 7 and 8. The inflation of buoyant cable 5 produces a force against pinch rollers 7 and 8 that overcomes the force of take-up spring 9 allowing accumulator 6 and buoyant cable 5 to deploy to the water's surface where it lays ready to receive radio communications.

The fourth condition assumes that the submarine is still at its operational depth and has received the required communications. At this point, the submarine starts the process of reeling in buoy 1. During this phase, sea pressure on buoyant cable 5 is increasing, forcing air from cable 5 to accumulator 6. This continues to occur until sea pressure on buoyant cable 5 has completely flattened it, forcing all the air that was in cable 5 into accumulator 6. With buoyant cable 5 flattened by sea pressure, the take-up spring 9 is now of sufficient strength to reel in buoyant cable 5. When this is completed, the solenoid operated locking means is actuated to secure the antenna system in a stowed condition. Buoyant cable 5 and accumulator 6 remain in this position until the cycle is repeated.

A sea water drain port 12 is provided in communication with cable reel 4 to permit sea water to drain from reel 4 after the cable 5 has been retrieved.

Figures 4, 5, 6, 7:
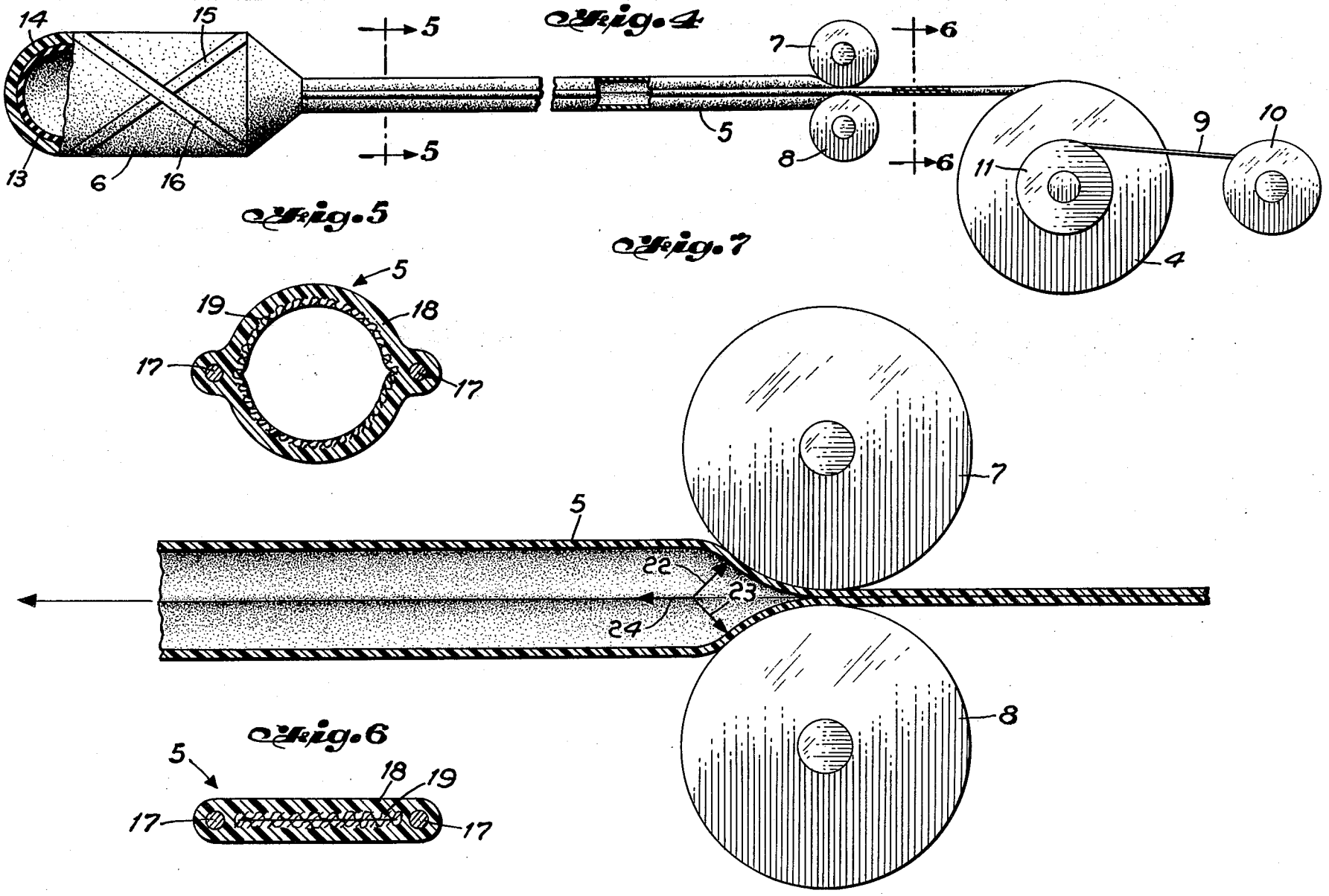
FIG. 4 is a schematic illustration of all of the major components of the floating cable antenna system in a partially deployed condition in accordance with the principles of the invention in a partially deployed condition.
FIG. 5 is a cross-sectional view of the buoyant cable taken along lines 5—5 of FIG. 4 illustrating the inflated condition of the buoyant cable.
FIG. 6 is a cross-sectional view taken along lines 6—6 of FIG. 4 illustrating the deflated condition of the buoyant cable.
FIG. 7 is a cross-sectional view of the buoyant cable illustrating the action of the air pressure against the pinch rollers in order to produce deployment of the buoyant cable in accordance with the principles of the present invention.

Referring to FIG. 4 there is illustrated a schematic view of all of the major components of the floating cable antenna system described in connection with FIGS. 2 and 3. Accumulator 6 includes an expandable bladder 13 connected to inflatable buoyant cable 5. Bladder 13 expands when sea pressure is great enough to flatten buoyant cable 5 thereby forcing air into bladder 13 and deflates when sea pressure on buoyant cable 5 is less than air pressure in bladder 13. The housing 14 of accumulator 6 is made of a buoyant or near buoyant insulation material, such as fiberglass, and is designed to withstand the sea pressure that is produced by deep submergence. Items 15 and 16 are alternate cross loop antennas made as an integral part of the outer surface of housing 14 of accumulator 6. The loops 15 and 16 may be used as the receiving antenna in conjunction with conductors 17 that are shown in FIGS. 5 and 6.

FIGS. 5 and 6 illustrate the cross-section of buoyant cable 5 for an inflated condition in FIG. 5 and a deflated condition in FIG. 6. Buoyant cable 5 includes a buoyant flexible insulation material 18, two flexible electrical conductors 17 and a non-stretchable woven fabric 19. The walls of buoyant cable 5 are made from a buoyant flexible insulation material, such as polyethylene, rubber or other materials that satisfy the requirements. Electrical conductors 17 extend the entire length of cable 5, one end of the electrical conductor pair being connected to the accumulator 6 and the other end terminating in the slip ring assembly 20 of FIGS. 1 and 2 with slip ring assembly 20 being connected to electro-mechanical cable 3 by conductor 21 as shown in FIGS. 1 and 2. The two conductors 17 are electrically joined together at each end and are used as the primary receiving antenna. Conductors 17 also provide the necessary tensile strength for buoyant cable 5.

Referring to FIG. 7 there is illustrated therein the action of air pressure in buoyant cable 5 against pinch rollers 7 and 8 in order to produce deployment of buoyant cable 5. The forces against pinch rollers 7 and 8 are indicated by the arrows 22 and 23 resulting in a force to deploy cable 5 as represented by arrow 24.

Figure 8:
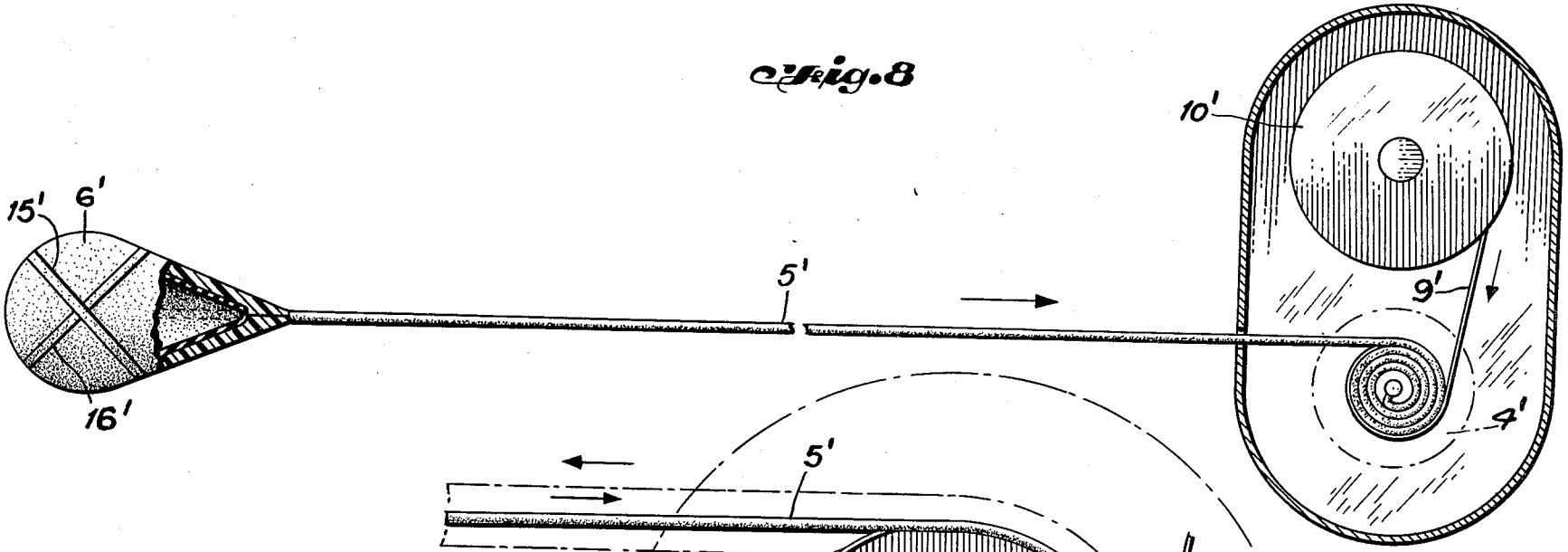
FIG. 8 is a schematic illustration of a second embodiment of the floating cable antenna system in accordance with the principles of the present invention.
Figure 9:
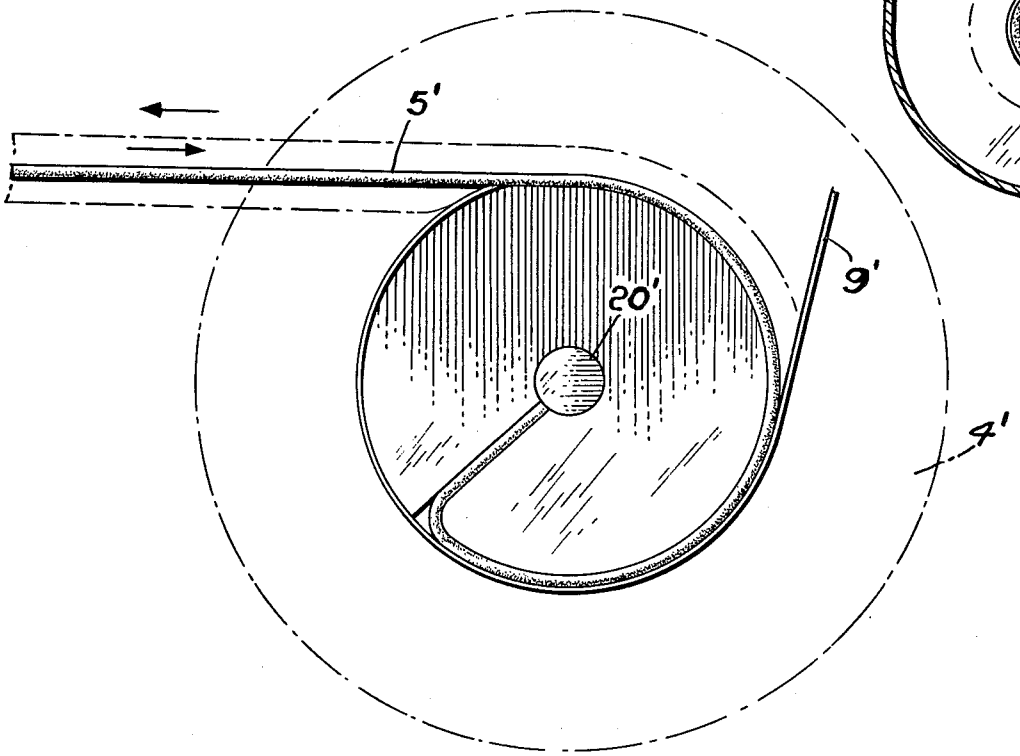
FIG. 9 is an enlarged view of the cable reel of FIG. 8.

Referring to FIGS. 8 and 9 there is illustrated an alternate arrangement for deploying and retrieving a floating cable antenna from a buoy in accordance with the principles of this invention. When the buoy is released from a travelling submerged submarine, it raises toward the surface. During this phase the sea pressure on buoyant cable 5' is diminishing to a point where air pressure in accumulator 6' is greater than the sea pressure on buoyant cable 5'. When this occurs, buoyant cable 5' is inflated as illustrated by the dot dash lines of FIG. 9. Deployment is accomplished due to the tendency of buoyant cable 5 to straighten out from its bent position around cable reel 4', thereby producing a rotational force in cable reel 4' and in doing so deploys buoyant cable 5'. Aiding in the deployment of buoyant cable 5' is the force produced by the buoyancy and drag on buoyant cable 5' and the rotational force in cable reel 4'.

When the buoy is being reeled into the submerged submarine, sea pressure on buoyant cable 5' gradually increases with depth, until cable 5' flattens. This allows the force of take-up spring 9' to rotate cable reel 4' and reel in buoyant cable 5' sandwiched between successive turns of take-up spring 9'.

The advantages of the floating cable antenna system described hereinabove are as follows:

1. The buoyant cable 5 or 5' is stored in a deflated condition. Therefore, a smaller and lighter cable reel 4 or 4' can be used.
2. Since more of cable 5 or 5' can be stored, a submarine can travel at greater depths and higher speeds and still maintain communications.
3. The deployment and retrieval mechanism is simple, almost care-free and does not require activation forces other than those supplied by sea pressure and torsional springs. The deployment and retrieval operation is completely automatic, depending solely on varying sea depth to supply varying sea pressure for activation.
4. Due to the size, weight and simplicity of the floating cable antenna system hereinabove described, the entire system can be packaged in a towed buoy. This advantage in itself presents other advantages in maneuverability, reliability and effectiveness.

While I have described above the principles of my invention in connection with specific apparatus it is to be clearly understood that this description is made only by way of example and not as a limitation to the scope of my invention as set forth in the objects thereof and in the accompanying claims.

I claim:

1. A floating cable antenna system for a submerged submarine comprising:
a buoy;
an electro-mechanical cable connecting said buoy to said submarine;
an inflatable buoyant cable having a pressure accumulator containing a medium under a given pressure attached to one end of said buoyant cable adjacent the outer surface of said buoy;
a cable reel disposed in said buoy to store said buoyant cable, the other end of said buoyant cable being attached to said cable reel; and
an arrangement in said buoy associated with said buoyant cable and said cable reel to assist in deploying and retrieving said buoyant cable, said deploying and retrieving of said buoyant cable being under the control of sea pressure acting on said buoyant cable.

2. A system according to claim 1, wherein said arrangement includes
a pair of pinch rollers engaging said buoyant cable in a deflated condition at a point spaced from said accumulator, said given pressure inflating said buoyant cable and exerting a force for said pinch rollers to deploy said buoyant cable when said given pressure is greater than said sea pressure acting on said buoyant cable.

3. A system according to claim 2, wherein said arrangement further includes
a take-up spring assembly associated with said cable reel to retrieve said buoyant cable when said sea pressure is greater than said given pressure and said buoyant cable is deflated by said medium being forced by said sea pressure into said accumulator.

4. A system according to claim 3, wherein said spring assembly includes
a take-up spring,
a first take-up reel fastened to said spring, and
a second take-up reel fastened to said spring and to said cable reel, said torsional forces exerted by said spring being transferred to said cable reel by said second take-up reel.

5. a system according to claim 3, wherein said spring assembly includes
a take-up spring having one end connected to said cable reel, and
a take-up reel fastened to the other end of said spring,
said buoyant cable when deflated being sandwiched between successive turns of said spring on said cable reel.

6. A system according to claim 3, wherein said accumulator includes
an outer crushproof covering, and
a deflatable and inflatable bladder contained within said crushproof covering connected to said buoyant cable.

7. A system according to claim 3, wherein said buoyant cable includes
a buoyant hollow flexible insulation material,
a non-stretchable woven fabric contained in said insulation material, and
a pair of flexible electrical conductors contained in said insulation material to act as an antenna and to provide tensile strength for said buoyant cable.

8. A system according to claim 7, wherein said arrangement further includes
slip rings connected to said cable reel to provide electrical continuity between said pair of electrical conductors and said electro-mechanical cable.

9. A system according to claim 8, wherein said accumulator includes
crossed loop antennas as an integral part of the outer surface thereof, said loop antennas being connected to said pair of electrical conductors to provide an antenna system for said submarine in conjunction with said pair of electrical conductors.

10. A system according to claim 1, wherein said arrangement includes
a take-up spring assembly associated with said cable reel to retrieve said buoyant cable when said sea pressure is greater than said given pressure and said buoyant cable is deflated by said medium being forced by said sea pressure into said accumulator.

11. A system according to claim 10, wherein said spring assembly includes
a take-up spring,
a first take-up reel fastened to said spring, and
a second take-up reel fastened to said spring and to said cable reel, said torsional forces exerted by said spring being transferred to said cable reel by said second take-up reel.

12. A system according to claim 10, wherein said spring assembly includes
a take-up spring having one end connected to said cable reel, and
a take-up reel fastened to the other end of said spring,
said buoyant cable when deflated being sandwiched between successive turns of said spring on said cable reel.

13. A system according to claim 10, wherein said accumulator includes
an outer crushproof covering, and
a deflatable and inflatable bladder contained within said crushproof covering connected to said buoyant cable.

14. A system according to claim 10, wherein said buoyant cable includes
a buoyant hollow flexible insulation material,
a non-stretchable woven fabric contained in said insulation material, and
a pair of flexible electrical conductors contained in said insulation material to act as an antenna and to provide tensile strength for said buoyant cable.

15. A system according to claim 14, wherein said arrangement further includes
slip rings connected to said cable reel to provide electrical continuity between said pair of electrical conductors and said electro-mechanical cable.

16. A system according to claim 8, wherein said accumulator includes
crosses loop antennas as an integral part of the outer surface thereof, said loop antennas being connected to said pair of electrical conductors to provide an antenna system for said submarine in conjunction with said pair of electrical conductors.

17. A system according to claim 1, wherein said accumulator includes an outer crushproof covering, and a deflatable and inflatable bladder contained within said crushproof covering connected to said buoyant cable.

18. A system according to claim 1, wherein said buoyant cable includes a buoyant hollow flexible insulation material, a non-stretchable woven fabric contained in said insulation material, and a pair of flexible electrical conductors contained in said insulation material to act as an antenna and to provide tensile strength for said buoyant cable.

19. A system according to claim 18, wherein said arrangement includes slip rings connected to said cable reel to provide electrical continuity between said pair of electrical conductors and said electro-mechanical cable.

20. A system according to claim 19, wherein said accumulator includes crossed loop antennas as an integral part of the outer surface thereof, said loop antennas being connected to said pair of electrical conductors to provide an antenna system for said submarine in conjunction with said pair of electrical conductors.

21. A system according to claim 1, wherein said arrangement includes a take-up spring having one end connected to said cable reel, and a take-up reel fastened to the other end of said spring, said buoyant cable when deflated being sandwiched between successive turns of said spring on said cable reel, said given pressure inflating said buoyant cable and exerting a force on said successive turns of said spring to deploy said buoyant cable when said given pressure is greater than said sea pressure acting on said buoyant cable.

22. A system according to claim 1, wherein said buoy includes a faired mast extending therefrom in communication with said cable reel to contain and protect said accumulator when said accumulator and said buoyant cable are in a stowed condition.

* * * * *